US009463920B2

(12) United States Patent
Crossley

(10) Patent No.: US 9,463,920 B2
(45) Date of Patent: Oct. 11, 2016

(54) LID FOR CHAIN CONTAINER

(71) Applicant: THE MIBRO GROUP, Toronto (CA)

(72) Inventor: Greg Crossley, Toronto (CA)

(73) Assignee: THE MIBRO GROUP, Toronto, Ontario (CA)

( * ) Notice: Subject to any disclaimer, the term of this patent is extended or adjusted under 35 U.S.C. 154(b) by 16 days.

(21) Appl. No.: 14/327,008

(22) Filed: Jul. 9, 2014

(65) Prior Publication Data

US 2016/0009461 A1 Jan. 14, 2016

(51) Int. Cl.

| | |
|---|---|
| ***B65D 85/00*** | (2006.01) |
| ***B65D 43/02*** | (2006.01) |
| ***B65D 17/00*** | (2006.01) |
| ***B65D 21/02*** | (2006.01) |
| ***B65D 83/00*** | (2006.01) |

(52) U.S. Cl.

CPC ..... *B65D 85/70* (2013.01); *B65D 17/161* (2013.01); *B65D 21/0219* (2013.01); *B65D 43/0204* (2013.01); *B65D 83/00* (2013.01)

(58) Field of Classification Search

CPC ..... B65D 85/04; B65D 51/24; B65D 47/061

USPC ..... 206/409, 388, 389; 220/212, 213, 287

See application file for complete search history.

(56) References Cited

U.S. PATENT DOCUMENTS

| | | | | |
|---|---|---|---|---|
| 2,580,878 | A * | 1/1952 | Bartlett | A47F 13/045 242/146 |
| 5,103,977 | A * | 4/1992 | Douglas | B65H 75/364 206/388 |
| 5,201,419 | A | 4/1993 | Hayes | |
| 5,293,998 | A | 3/1994 | George | |
| 5,299,706 | A * | 4/1994 | Wardell, Jr. | B65D 51/24 220/254.1 |
| D348,834 | S | 7/1994 | Wardell, Jr. | |
| D350,688 | S | 9/1994 | Wardell, Jr. | |
| 6,041,919 | A * | 3/2000 | Adams | A45D 34/046 206/15.2 |
| 6,394,301 | B1 | 5/2002 | Koch | |
| 7,134,574 | B2 * | 11/2006 | Braunstein | B44D 3/128 222/108 |
| D606,753 | S | 12/2009 | Tuominen et al. | |
| 8,235,210 | B2 * | 8/2012 | De Lacerda | B65D 85/04 206/393 |
| 8,360,264 | B2 * | 1/2013 | Tuominen | B65D 21/0219 206/349 |

* cited by examiner

*Primary Examiner* — Jacob K Ackun
*Assistant Examiner* — Jennie Pagan
(74) *Attorney, Agent, or Firm* — Leason Ellis LLP

(57) ABSTRACT

A container for storing and dispensing continuous lengths of chain includes a base having a hollow interior for storing the chain. The base has an open end defined by a top edge. The container also includes a lid that has a storage orientation and a dispensing orientation in which the lid is inverted relative to the storage orientation. The lid includes a first opening for dispensing the chain from the hollow interior. A coupling member of the lid is configured to attach the lid to the open end of the base in each of the storage and dispensing orientations. The coupling member can be configured to produce a releasable snap-fit between the lid and the base.

26 Claims, 5 Drawing Sheets

DETAIL F
SCALE 1 : 1

SECTION E-E
SCALE 1 : 5

DETAIL H
SCALE 1 : 1

LID FOR CHAIN CONTAINER

TECHNICAL FIELD

The present invention is related to storage and dispensing containers for continuous material and more particularly, is directed to a lidded container that is especially configured for storage and dispensing of continuous lengths of chains.

BACKGROUND

Retail establishments which sell chain, cable, rope and the like, typically encounter a number of difficulties therewith. Because of the wide range of consumer needs, the retail establishments stock a large variety of such items in various sizes and types in order to satisfy consumer sentiment. As a result, a large amount of in-store space must be designated for this purpose. Traditionally, bulk chain or the like is sold in large plastic buckets sealed with removable lids and flipped on their sides for display. Once flipped, the bucket lid in effect becomes the point of purchase graphics medium, and the product (the chain) is threaded through a hole in the lid to make it available for purchase.

Chains sold in buckets face a multitude of issues. First, it is extremely difficult to maintain a tidy appearance at the point of purchase. In examining and selecting a chain for purchase, many consumers unwind and unravel lengths of a number of different types of material. Ultimately after looking over a number of different chains, the consumer will select one and the others are left for store personnel to replace properly. Traditional chain buckets suffer from the disadvantage of not having a means of organizing the tail end of the chain and thus, the tail end hangs down in front of the bucket and can obstruct other merchandise. Second, generally available buckets and bucket lids are designed with functionality in mind first, and aesthetics second, thereby making them a poor vehicle for product promotion at the store level.

There is therefore a need in the market place for an apparatus for chain merchandising which allows the various types of chains to be presented in a relatively neat fashion and with improved aesthetics and functionality.

SUMMARY

In accordance with one embodiment, a container for storing and dispensing continuous lengths of chain includes a base having a hollow interior for storing the chain. The base has an open end defined by a top edge. The container also includes a lid that has a storage orientation and a dispensing orientation in which the lid is inverted relative to the storage orientation. The lid includes a first opening for dispensing the chain from the hollow interior. A coupling member of the lid is configured to attach the lid to the open end of the base in each of the storage and dispensing orientations.

The lid comprises a peripheral wall and a transverse wall that extends between and internal to the peripheral wall. The coupling member is formed at least as a part of the peripheral wall and the first opening being formed in the transverse wall. The transverse wall is disposed at an angle other than 90 degrees relative to the peripheral wall so as to form an inclined surface when the lid is in the storage orientation and a declined surface when the lid is in the dispensing orientation. This orientation provides a number of advantages as described herein. The transverse wall includes an integral trough that is in communication with the first opening at one end thereof. The trough is configured to receive the chain from the first opening in the dispensing orientation. The trough comprises a recessed channel formed in the transverse wall and having a concave shape. The recessed channel acts as a waterslide in which the chain sits and serves to guide the chain during dispensing thereof.

BRIEF DESCRIPTION OF DRAWING FIGURES

DETAILED DESCRIPTION OF CERTAIN EMBODIMENTS

Figure 4:
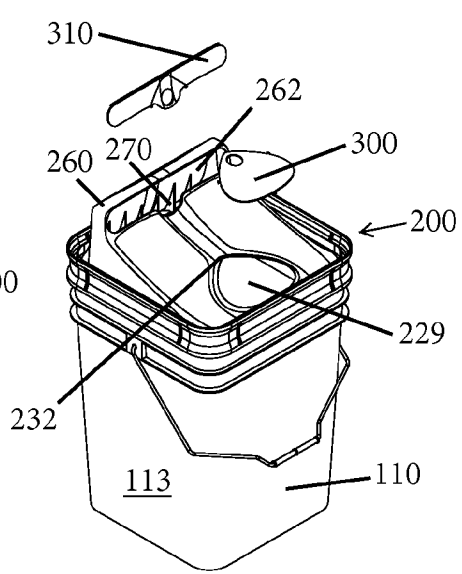
FIG. 4 is a top and side perspective view showing removal of protective elements from the lid.
Figure 3:
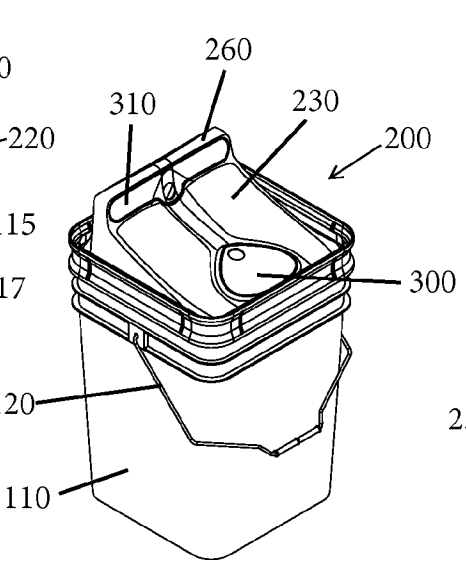
FIG. 3 is a top and side perspective view showing the lid coupled to the container with the lid being in the second orientation.
Figure 2:
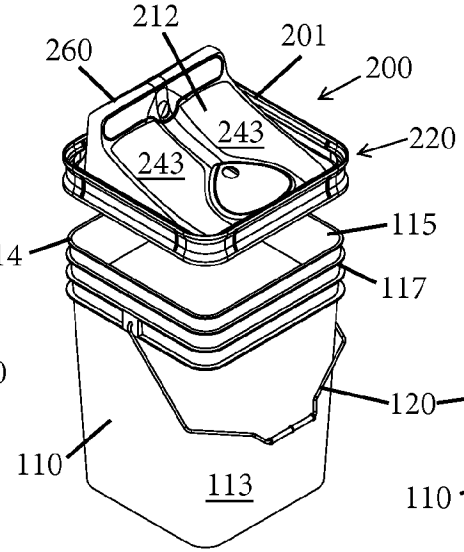
FIG. 2 is an exploded top and side perspective view of the lid container with the lid being shown exploded from the container and in an inverted second orientation.
Figure 1:
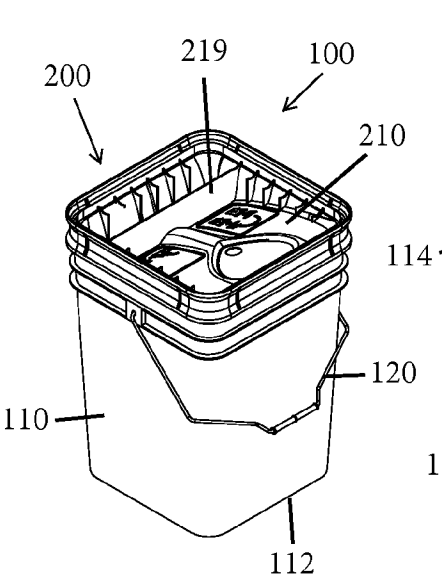
FIG. 1 is a top and side perspective view of a lid container for storing and dispensing chain according to one embodiment and being shown with the lid in a first orientation.
Figure 5:
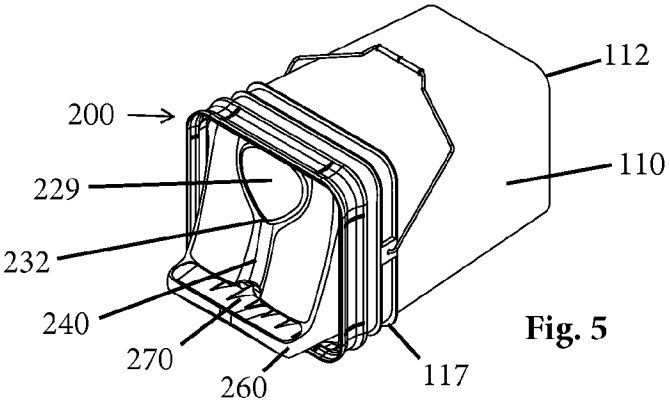
FIG. 5 is a side perspective view of the lid container laid on its side.

FIGS. 1-13 illustrate a chain storage and dispensing container 100 that includes a base 110 and a lid member 200 that is removably coupled to the base 110.

Chain buckets, such as container 100, regularly travel from overseas manufacturing facilities to warehouses in shipping containers and transport trucks. It will be appreciated that this journey is not a clean one in that dust and grime tend to coat any exposed surface, obscuring labels and generally reducing the aesthetic appeal of the product. To make matter worse, the exercise of filling a plastic bucket with a conductive product (bulk chain) causes the filled bucket to accumulate a static charge. This charge causes the bucket to attract dust particles, similar to a magnet, and makes cleaning the bucket even more difficult.

Based on the foregoing, the lid 200 of the present invention is designed for use in two different orientations relative to the bucket 110, namely, a storage/transportation orientation (position) and a dispensing orientation (position), as discussed herein.

The base 110 has a closed end 112 and an opposite open end 114 through which a chain 10 is received. The base 110 can be in the form of a conventional chain bucket. The base 110 can have a handle 120 that allows the container 100 to be held and transported. The base 110 can have any number of different shapes including a square shape as shown in the figures. As shown, the corners of the base 110 can be rounded. The base 110 is thus defined by a floor 111 and a side wall 113 that extends upwardly from the floor 111 and terminates with a top edge 115 at the open end 114. An outer surface of the side wall 113 can include one or more ribs 117.

The base (bucket) 110 defines a hollow interior into which the chain 10 is received and stored as described herein.

In accordance with the present invention, the lid member 200 is a "flip lid" in that the lid 200 can be mated to the bucket 110 in both a "lid down" storage orientation (see, FIGS. 6-8) and a "lid up" dispensing orientation (see, FIGS. 9-13). FIGS. 1-5 show a series of steps involved in transforming the lid 200 from the "lid down" storage orientation (FIG. 1) to the "lid up" dispensing orientation (FIGS. 2-5). The lid 200 thus has coupling features that allow it to be mated to the top edge 115 in both the storage and dispensing orientations. As described below, in FIG. 1, the lid 200 is in the storage/transportation position in which the dispensing and guide features of the lid 200 are protected and shielded from the environment.

As shown in the figures, a body 201 of the lid 200 has a first face 210 that is displayed upward when the lid 200 is in the storage orientation and an opposite second face 212 that is disposed upward when the lid 200 is inverted and assumes the dispensing orientation. The body 201 of the lid 200 is defined by a peripheral wall 220 that includes the coupling features for securely attaching the lid 200 to the bucket 110 in both the storage and dispensing orientations. Between the peripheral wall 220, the body 201 is defined by a transverse wall 230 that is integral to the peripheral wall 220. The first face 210 is thus one surface of the transverse wall 230 and the second face 212 is the other surface of the transverse wall 230.

The body 201 includes an opening 229 through which the chain 10 exits and thus can be considered as a chain exit. The chain opening 229 can have different shapes and sizes and as shown in the figures, the chain opening 229 can have an irregular shape. The chain opening 229 has a section that is tapered and comes to a narrow section 232 that defines the minimum space of the chain opening 229. The narrow section 232 can be considered to be a bottom edge of the openings 230 and can have a V-shape as shown. The chain opening 229 has a maximum width in a central (intermediate) section of the chain opening 229. As discussed herein, the chain 10 is dispensed through the narrow section 232 of the opening 229 when the container 100 is laid on its side as in the retail establishment. The narrow section 232 thus serves to guide the chain 10 as it is being dispensed as described herein.

Figure 8:
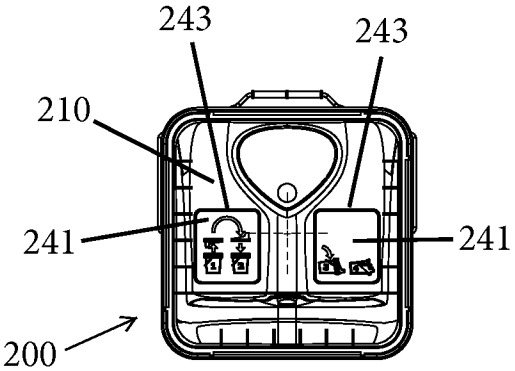
FIG. 8 is a top plan view of the lid container with the lid in the first orientation.

The transverse wall 230 includes a guide channel (trough) 240 that is formed integrally in the body 201. The characteristics and nature of the guide channel (trough) 240 varies depending upon whether the guide channel 240 is viewed from the first face 210 or the second face 212. In the storage position of FIG. 1 when the first face 210 faces upright, the guide channel 240 has a convex shape, while when the second face 212 faces upright, the guide channel 240 has a concave shape to allow the chain 10 to be contained and travel within the guide channel 240 during the dispensing action. As best shown in FIG. 8, the second face 212 has surface area on either side of the convex shaped guide channel 240. As shown in FIG. 8, instructions 241 can be disposed along the second face 212. These instructions 241 can include graphic illustrations (icons) showing how to convert the container 100 from the storage orientation to the dispensing orientation (i.e., graphic illustrations showing step-by-step how to flip the lid 200). The icon-based instruction set can be debossed into the first face 210. When formed in this manner, the instructions are thus recessed into the surface rather than raised, a manufacturer is free to design their own instruction labels and adhere them over the debossed instruction set. A raised border 243 can surround the deposed instructions 241 and thus, the raised border 243 can act as a registration edge to assist in the placement of such optional labels.

The guide channel 240 can be considered to be a "waterslide" in that the chain 10 sits and rides within the guide channel 240 as it is dispensed.

The transverse wall 230 is set at an angle relative to the peripheral wall 220. The angled nature of the transverse 230 is best appreciated with reference to the cross-sectional views of FIGS. 7 and 10. The chain opening 229 is formed near one edge (side) of the lid 200. The transverse wall 230 also includes a protrusion 260 that extends across the width of the lid 200 (the width of the opening 229) and extends outwardly relative to the transverse wall 230. In other words, the protrusion 260 is raised relative to the second face of the body 201. The transverse wall 230 transitions to the protrusion 260 in a swept manner. The guide channel 240 extends between the upstanding protrusion 260 and the chain opening 229. As shown in the figures, the guide channel 240 can be centrally located within the transverse wall 230.

The protrusion 260 can also include an opening or hole which can be considered to be a trough hole which is configured to receive the chain tail and allow the chain tail to be collected. This opening is in communication with the guide channel (trough) 240.

Figure 12:
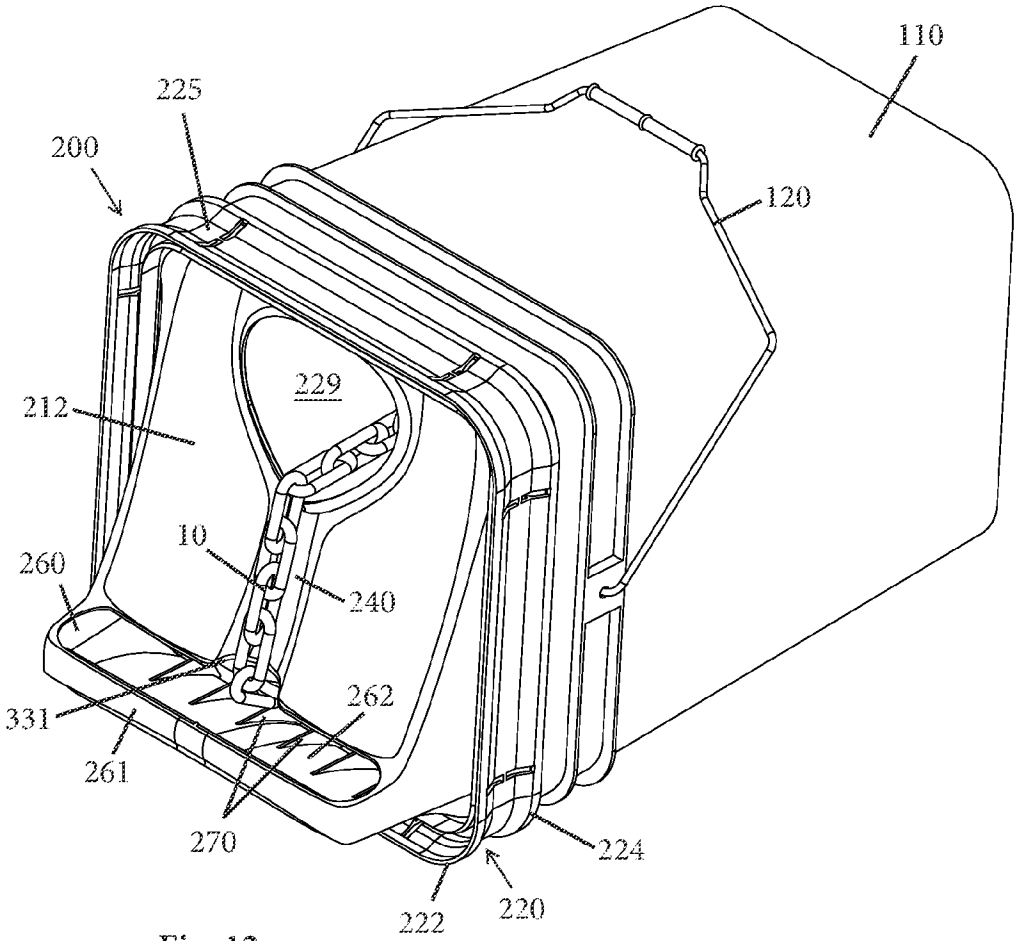
FIG. 12 is a side perspective view of the lid container laid on its side with a chain being shown in a retail dispensing orientation.

When the container 100 is placed on its side as shown in FIG. 12, the protrusion 260 acts as a ledge for supporting a tail end of the chain 10 and the trough hole formed in the protrusion 260 can receive the chain tail for routing of the chain. As shown in the figures, the transverse wall 230 is angled to such a degree that a portion of the wall extends above (or below) the peripheral wall 220 and further, a substantial portion of the upstanding protrusion 260 is extends above (or below) the peripheral wall 220. The protrusion 260 is thus positioned along one edge of the lid 200, while the opening 229 is located along an opposite edge of the lid 200.

Along an inner surface 262 of the upstanding protrusion 260, there is a plurality of ribs 270.

Figure 18:
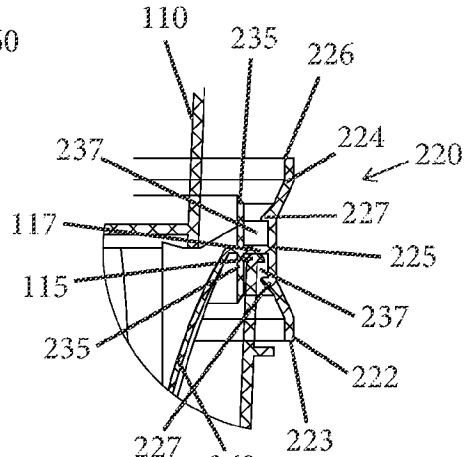
FIG. 18 is a cross-sectional view showing the coupling between the two lid containers.

With reference to FIGS. 12 and 18, the peripheral wall 220 has flared out first and second sections 222, 224, respectively in that a central section 225 located therebetween is located more inward compared to the first and second sections 222, 224 which flare radially outward. The first section 222 terminates in a first edge 223 and the second section 224 terminates in a second edge 226. The peripheral wall 220 thus has an outwardly facing concave shape.

The transverse wall 230 includes an inner raised wall 235 that extends outwardly from the first face 210 and also from the second face 212 of the transverse wall 230. The inner raised wall 235 can be formed such that it is perpendicular to the respective faces 210, 212. The inner raised wall 235 is thus located internal to the peripheral wall 220 and spaces 237 are formed between the inner raised wall 235 and the peripheral wall 220. The height of the inner raised wall 235 is less than the height of the peripheral wall 220. The space 237 can be thought of as a continuous track formed between the walls 230, 235. As discussed therein, each space 237 is designed to receive the top edge 115 of the bucket 110 for securely attaching the lid 200 to the bucket 110 in either of the storage and dispensing orientations.

The protrusion 260 is thus located internal to the inner raised wall 235. The inner raised wall 235 is thus left intact along the upstanding protrusion 260. The protrusion 260 is thus defined by a first swept surface that extends from the inner raised wall 235 and a second swept surface that extends to the angled inner portion of the transverse wall 230. A top 261 of the protrusion 260 can be a rounded top.

Figure 7:
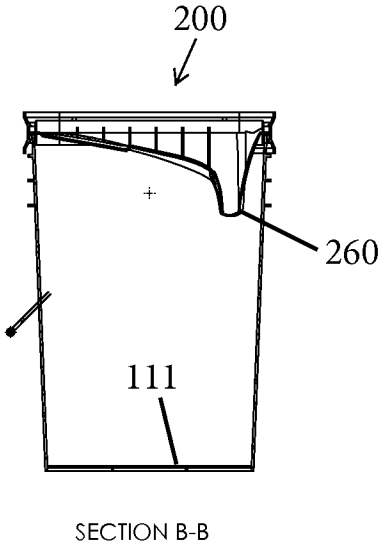
FIG. 7 is a cross-sectional view taken along line 7-7 of FIG. 6.
Figure 6:
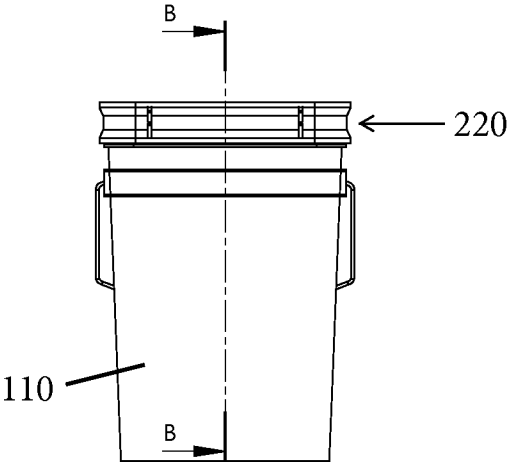
FIG. 6 is a side view of the lid container with the lid in the first orientation.
Figure 10:
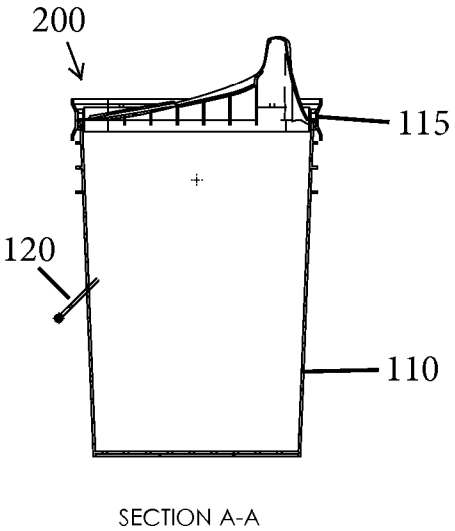
FIG. 10 is a cross-sectional view taken along line 10-10 of FIG. 9.
Figure 9:
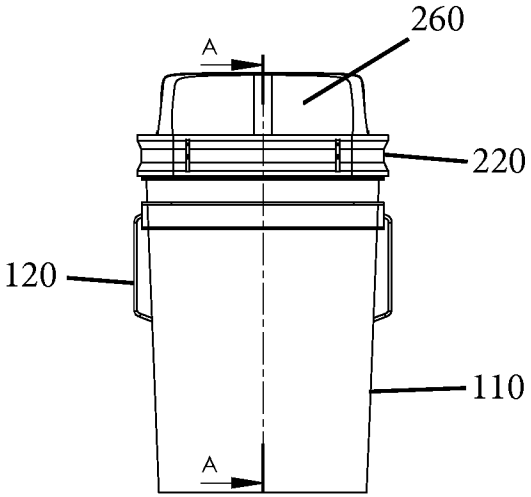
FIG. 9 is a side view of the lid container with the lid in the first orientation.
Figure 11:
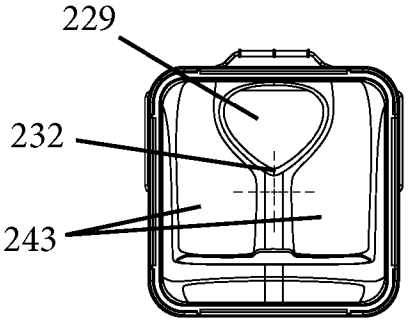
FIG. 11 is a top plan view of the lid container with the lid in the first orientation.
Figure 13:
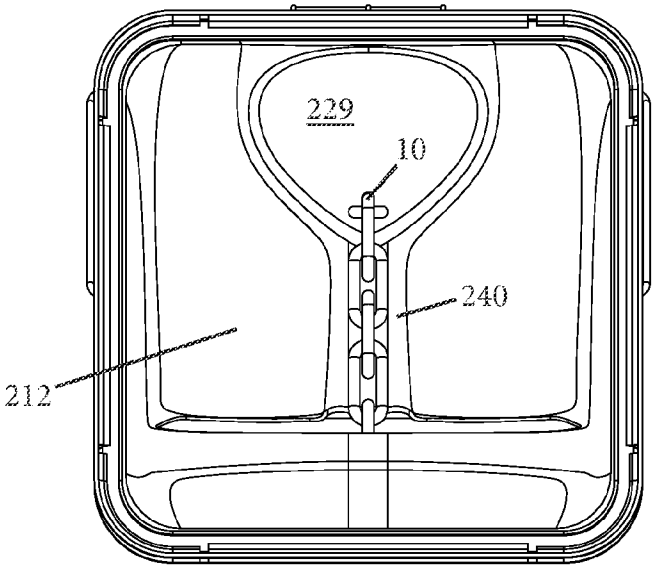
FIG. 13 is a top plan view thereof showing the chain.

As shown in the figures, the lid 200 is advantageously configured such that the lid 200 can be securely attached to the bucket 110 with the lid 200 either being in the storage orientation (first face up) or in the dispensing orientation (second face up). The lid 200 can be attached in either of these orientations due to the construction of the transverse wall 230. More specifically, there are two opposing spaces 237 one of which receives the top edge 115 of the bucket 110 for coupling the bucket 110 to the lid 200 depending upon which orientation the lid 200 is in. More specifically, FIG. 7 shows the lid 200 in the storage orientation with the top edge 115 received in the space 237. The top edge 115 intimately engages the inner raised wall 235 and the peripheral wall 220 such as by a friction fit. As shown in FIG. 7, the protrusion 260 extends inwardly into the hollow interior space of the bucket 110 (spaced close to one side wall of the bucket 110). More specifically, FIGS. 10 and 18 show the lid 200 in the dispensing orientation with the top edge 115 received in the space 237. The top edge 115 intimately engages the inner raised wall 235 and the peripheral wall 220 such as by a friction fit. As shown in FIG. 10, the protrusion 260 extends outwardly away from the bucket 110.

It will thus be appreciated that the peripheral wall 220 has a degree of symmetry in that the flared out first and second sections 222, 224 and the inner raised wall 235 have symmetry so as to define two symmetric spaces 237 that are located on opposite sides of the transverse wall 230.

The coupling between the bucket 110 and the lid 200 is best shown in the enlarged view of FIG. 18. As can be seen in FIG. 18, an inner surface of the central section 225 includes a pair of retaining ribs 227 which mate with the top edge 115 to securely, yet releasably, attach the lid 200 to the bucket 110. In particular, the lid 200 can attach to the bucket 110 in a snap-fit manner. The top edge 115 can include an overhang 117 defined by an undercut edge. The retaining ribs 227 can also include undercut edges. Each of the undercut edges is defined by a planar surface and when mated together, the two planar surface at least partially contact one another to prevent free removal of the lid 200 from the bucket 110. It will be appreciated that the peripheral wall 220 has some flexibility given its construction and the nature of how it depends from the transverse wall. The top edge 115 of the bucket 100 also has flexibility and thus, when the top edge 115 is inserted into the space 237, the overhang 117 at the top edge 115 contacts the respective retaining rib 227 and once the overhang 117 clears the retaining rib 227, it locks (snap-fits) in place. As mentioned, the free removal of the lid 200 is prevented by the engagement between the two planar surfaces of the overhang 117 and the retaining rib 227. However, if enough force is used, the overhang 117 clears the retaining rib 227 in the opposite direction as the lid 200 is removed from the bucket 110. The symmetrical nature of the peripheral wall 220 and the retaining ribs 227 provides the lid 200 with the ability to flip and be secured to the bucket 110 in either the storage or dispensing orientations.

The first face 210 (the underside) of the body 201 includes a wall 219 that extends from one side to another side of the bucket 110. Since the bucket 110 is filled with chain 10 and then turned on its side to be merchandised, the chain 10 will slide downwards and out towards the front of the bucket 110. However, there needs to space inside and behind the lid trough 240 to accept the ends of the chain tails. If this space was full of chain from the bucket, the trough 240 would not be able to function properly. To mitigate this, the horizontal wall 219 exists on the interior surface (first face 210) when the lid 200 is flipped. The role the wall 219 is to help retain the mass of unremoved chain 10 and maintain the open space for the end of the chain tail. Due to molding constraints, the wall 219 cannot entirely separate the trough space from the bucket space; however, the construction and placement of the wall 219 does, in practice, ensure that adequate space remains in the trough 240.

To mate with the rounded corners of the bucket 110, the lid 200 likewise has rounded corners. More specifically, since the lid 200 is designed to fit existing buckets 110, the surfaces on the lid 200 itself are created in such a way as to reconcile the "rounded square" edge path of the bucket 110 with the desired/required properties of the lid 200 (i.e., aesthetics and functionality). This has been achieved by using the inflection points of the bucket 110 opening (the points where straight lines transition to radii and vice versa) as originating points for the edges or each discrete surface. The result of this is a harmonious transition from the profile of the bucket opening 229 to the holes and surfaces of the bucket lid 200.

Since the guide channel (trough) 240 is recessed relative to the second face 212 of the body 201, a pair of raised surfaces 243 that define the second face 212 are located on either side of the guide channel 240 and opening 229. These surfaces 243 provide surfaces to place product labels (POP labeling). A common issue with merchandising chain buckets is the tendency for chain to hang over the labels (POP labeling). This can obscure the labeling from a customer's view, or worse, scratch or stain the labeling itself. The lid 200 of the present invention overcomes these deficiencies in part due to the presence of the V-shaped section 232 of the opening 229. The V-shape causes the chain 10 to self-center under its own weight, keeping the chain 10 away from the labeling on surfaces 243 on either side of the guide channel 240 and chain 10.

As mentioned, the concave shaped guide channel 240 is located immediately below the V-shaped section 232 when the container 100 is laid on its side which is the normal retail dispensing orientation and thus, the channel 240 is located immediately beneath the lowest point of the exit opening (hole) 229. The guide channel 240 further captures the chain tail and also provides customers with a space behind the tail into which they can insert their hands to grasp the chain 10.

In addition, the opening 229 is oversized relative to conventional chain exits for retail chain containers. Once the container 100 is put into place in a retail establishment (and is laid on its side—see, FIG. 12), it is very likely that, as some point, the chain tail will fall back inside the bucket 110. This means that it must be easy for a store employee to reach back into the bucket 110 and grab the chain tail, and pull it back out. Accordingly, the opening 229 has been sized such that the width (at a location where it is at a maximum)

has been sized so that a man with a hand that is in the 95$^{th}$ percentile will be able to retrieve chain from inside the bucket 110.

Given that most chain merchandising buckets are kept on shelves that are lower than the eye level of most customers, the viewing angle of the labels (POP labeling) on traditional chain buckets is less than ideal. The lid 200 of the present invention overcomes these deficiencies by providing two large label placement surfaces 243 that are angled up, closer to perpendicular to a standing (or squatting) customer's viewing direction.

All holes formed in the lid 200 have tear-away covers. The lid 200 has two holes: one for the product to exit (the exit hole 229) and one for the tail to be collected (the through hole 331 (FIG. 12)), Both holes 229, 331 are preferably covered by a respective cover that is molded into the lid 200 itself. With reference to FIG. 4, a first cover 300 is disposed within the opening 229 and a second cover 310 is disposed within the trough (guide channel) hole 331.

Both covers 300, 310 feature large finger-holes, and both covers 300, 310 are perforated in such a way so that once the bucket (container 100) arrive at a store, a store employee is able to easily tear out and recycle the lid covers 300, 310 by inserting a finger into the finger hole and pulling the respective cover 300, 310 away from the lid 200.

These covers 300, 310 protects the contents of the bucket 110 from grim and dirt during shipping and storage. As shown in FIG. 4, when the container 100 is ready for use and the lid 200 is in the dispensing orientation, the covers 300, 310 are removed from the lid body.

Figure 15:
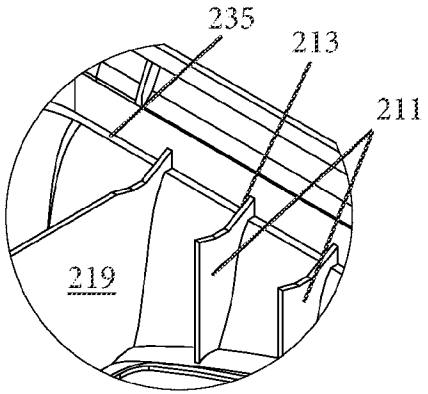
FIG. 15 is an enlarged view of a portion of the lid.
Figure 14:
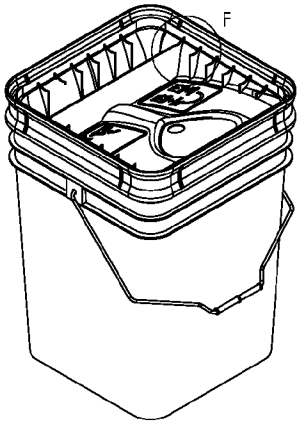
FIG. 14 is a side and top perspective view of the lid container with the lid in the first orientation.
Figure 16:
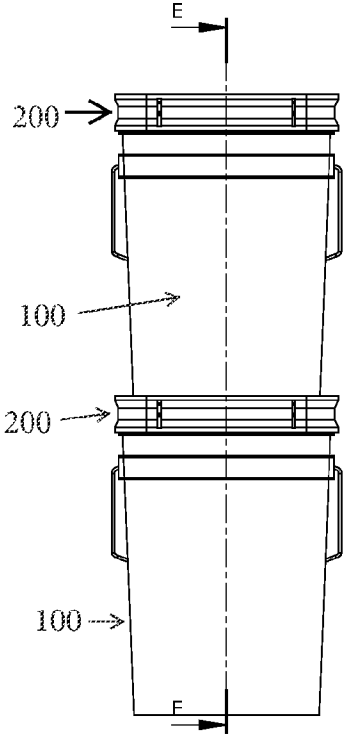
FIG. 16 is side view of two lid containers in a stacked relationship.
Figure 17:
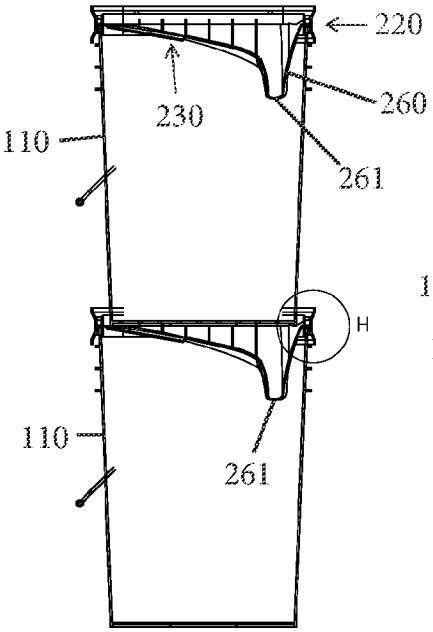
FIG. 17 is a cross-sectional view taken along the line 17-17 of FIG. 16.

The lid 200 can also be constructed to allow for stabile stacking between a plurality of containers 100 as shown in FIGS. 16-18. In particular, the first face 210 (inner face) has a pattern of ribs 211 formed thereon. As best shown in FIGS. 14-15, the ribs 211 extends inwardly from the raised inner wall 235 and are configured to act as a supporting surface for a second bucket 110 placed atop. The ribs 211 distribute the weight of the buckets 110 atop to the edges of the bucket 110 below, which is the strongest part of the bucket 110. As shown, the ribs 211 are spaced apart and are arranged parallel to one another along three sides of the lid body.

Further, the profile of each rib 211 includes a gentle lead-in ramp 213 (FIG. 15). The lead-in ramp 213 serves to help center the bucket 110 atop with the bucket 110 below. FIG. 18 is an enlarged close-up showing the stacking of two buckets 110 with the top bucket 110 being supported atop the bottom bucket 110. FIG. 18 also shows the coupling between the bucket 110 and the lid 200.

What is claimed is:

1. A container for storing and dispensing continuous lengths of chain comprising:

a base having a hollow interior for storing the chain, the base having an open end defined by a top edge; and a lid that has a storage orientation and a dispensing orientation in which the lid is inverted relative to the storage orientation, the lid including a first opening for dispensing the chain from the hollow interior;

wherein a coupling member of the lid is configured to attach the lid to the open end of the base in each of the storage and dispensing orientations;

wherein the lid comprises a peripheral wall and a transverse wall that extends between and internal to the peripheral wall, wherein the transverse wall comprises a sloped surface, wherein the transverse wall includes an integral trough that is formed along the sloped surface and is in communication with the first opening at one end thereof, the first o enin bein formed in the sloped surface of the transverse wall, the trough being configured to receive the chain from the first opening in the dispensing orientation and for allowing the chain to travel along the sloped surface of the transverse wall.

2. The container of claim 1, wherein the base comprises a bucket.

3. The container of claim 1, wherein the coupling member is formed as a part of the peripheral wall.

4. The container of claim 3, wherein the transverse wall is disposed at an angle other than 90 degrees relative to the peripheral wall so as to form an inclined surface when the lid is in the storage orientation and a declined surface when the lid is in the dispensing orientation.

5. The container of claim 1, wherein the trough comprises a recessed channel formed in the sloped surface of the transverse wall and having a concave shape.

6. The container of claim 3, wherein at least a portion of the transverse wall extends above the peripheral wall in the dispensing orientation.

7. The container of claim 3, wherein the lid further includes a protrusion that formed immediately adjacent the trough and which extends radially outward from the transverse wall above peripheral wall when the lid is in the dispensing orientation, an inner surface of the protrusion defining a ledge when the container is laid on its side with the first opening directly above the protrusion.

8. The container of claim 7, wherein the transverse wall includes an integral recessed trough that is in communication with the first opening at one end thereof and with the inner surface of the protrusion at an opposite end, the trough being configured to receive the chain from the first opening in the dispensing orientation and guide the chain to the protrusion which includes a second opening which is in communication with the hollow interior of the base, wherein the second opening is formed between one end of the trough and the an inner surface of the protrusion such that the trough is open to the first opening at a first end of the trough and the trough is open to the second opening at a second end of the trough.

9. The container of claim 8, wherein each of the first and second openings includes a tear-away cover for covering the respective opening during storage prior to use.

10. The container of claim 9, wherein each tear-away cover is formed in situ with the lid during a common molding process.

11. The container of claim 1, wherein the coupling member comprises a snap-fit fastener for snap-fittingly attaching the lid to the open end of the base.

12. The container of claim 1, wherein the transverse wall has a first face in which the trough is formed, the trough partitioning the first face into first and second display surfaces on which indicia can be provided.

13. The container of claim 3, wherein the peripheral wall includes ribs formed along a plurality of sides of the lid, the ribs extending inwardly toward a center of the lid and being configured to support a closed end of another base that is stacked on top of the container when the lid is in the storage orientation.

14. The container of claim 3, wherein the coupling member includes an inner peripheral wall and an outer peripheral wall that is spaced from the inner peripheral wall so as to create a peripheral space therebetween, the inner peripheral wall extending outwardly from both a first face and an opposite second face of the transverse wall so as to create a first peripheral space along the first face and a second peripheral space along the second face.

15. The container of claim 14, wherein the top edge of the base is received in the first peripheral space when the lid is in the storage orientation and is received within the second peripheral space when the lid is in the dispensing orientation.

16. The container of claim 14, wherein an inner surface of the outer peripheral wall includes first and second retaining ribs, one disposed in the first peripheral space and the other disposed in the second peripheral space for mating with an overhang formed at the top edge of the base for coupling the lid to the base in the storage and dispensing orientations respectively.

17. The container of claim 16, wherein the outer peripheral wall has a top flared out portion and a bottom flared out portion with a middle portion thereof being planar, the first retaining rib being formed at an interface between the top flared out portion and the middle portion and the second retaining rib being formed at an interface between the bottom flared out portion and the middle portion.

18. The container of claim 1, wherein the first opening includes a V-shaped bottom edge that causes the chain to self-center under its own weight and the trough is located beneath the V-shaped bottom edge when the container is laid on its side which is representative of a point of purchase orientation.

19. The container of claim 1, wherein the lid includes a second opening which is in communication with the hollow interior of the base, wherein the first opening is formed at and directly opens to a first end of the trough and the second opening is formed at and directly opens to an opposite second end of the trough.

20. A container for storing and dispensing continuous lengths of chain comprising:

a base having a hollow interior for storing the chain, the base having an open end defined by a top edge; and a lid that is configured to attach to the open end of the base and is configured to be positioned in a storage orientation and a dispensing orientation, the lid comprising a peripheral wall and a transverse wall that extends between and internal to the peripheral wall, the transverse wall being formed at an angle other than 90 degrees relative to the peripheral wall so as to form a recessed surface when the lid is in a storage orientation and a raised surface when the lid is in a dispensing orientation, the transverse wall including a first opening that has a tapered portion that defines a narrow bottom edge thereof and the transverse wall includes an integral concave shaped trough that is formed in a sloped surface of the transverse wall and is in communication with the tapered portion of the first opening, the trough being configured to receive the chain from the first opening and guide the chain for dispensing thereof when the lid is in the dispensing orientation.

21. The container of claim 20, wherein the lid includes a second opening which is in communication with the hollow interior of the base, wherein the first opening is formed at and directly opens to a first end of the trough and the second opening is formed at and directly opens to an opposite second end of the trough.

22. The container of claim 21, further including a raised protrusion formed at the second end of the trough and defining a ledge that has an axis that is perpendicular to a horizontal plane that passes through a top end of the peripheral edge.

23. The container of claim 22, wherein the second opening is defined between the second end of the trough and an inner surface of the ledge.

24. The container of claim 20, wherein in the dispensing orientation, the base is laid on one side thereof and the first opening is oriented above the first opening and the transverse wall is angled downwardly away from the first opening and forwardly away from the base.

25. A container for storing and dispensing continuous lengths of chain comprising:

a base having a hollow interior for storing the chain, the base having an open end defined by a top edge; and a lid that is configured to attach to the open end of the base and is configured to be positioned in a storage orientation and a dispensing orientation, the lid comprising a peripheral wall and a transverse wall that extends between and internal to the peripheral wall, the transverse wall comprising a sloped surface that intersects the peripheral wall along one edge of the sloped surface and is integrally joined to a raised protrusion along an opposite edge, the transverse wall including a first opening that is formed along the sloped surface and an integral trough being also formed in the sloped surface and extending from and being open to the first opening, the trough being configured to receive the chain from the first opening and guide the chain for dispensing thereof when the lid is in the dispensing orientation, wherein the lid includes a second opening which is in communication with the hollow interior of the base, the second opening being also in direct communication with the trough for receiving the chain.

26. The container of claim 25, wherein the first and second openings are disposed at opposite ends of the trough with the respective opposite ends of the trough opening directly into the first and second openings.

* * * * *